US007518588B2

(12) United States Patent
Lin

(10) Patent No.: US 7,518,588 B2
(45) Date of Patent: Apr. 14, 2009

(54) SOURCE DRIVER WITH CHARGE RECYCLING FUNCTION AND PANEL DISPLAYING DEVICE THEREOF

(75) Inventor: Che-Li Lin, Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 633 days.

(21) Appl. No.: 10/907,278

(22) Filed: Mar. 28, 2005

(65) Prior Publication Data

US 2006/0119596 A1 Jun. 8, 2006

(30) Foreign Application Priority Data

Dec. 7, 2004 (TW) ..... 93137732 A

(51) Int. Cl.
*G09G 3/36* (2006.01)

(52) U.S. Cl. ..... 345/98; 345/204

(58) Field of Classification Search ..... 345/87–104, 345/211–213, 204
See application file for complete search history.

(56) References Cited

U.S. PATENT DOCUMENTS 5,973,660 A * 10/1999 Hashimoto ..... 345/98
6,157,358 A * 12/2000 Nakajima et al. ..... 345/96
6,239,779 B1 * 5/2001 Furuya et al. ..... 345/87
6,650,310 B2 * 11/2003 Yoon ..... 345/87
7,403,185 B2 * 7/2008 Song et al. ..... 345/100

OTHER PUBLICATIONS

Kim et al., "A Multi-Level Multi-Phase Charge-Recycling Method for Low-Power AMLCD Column Drivers", IEEE Journal of Soulid-State Circuits, vol. 35, No. 1, Jan 2000, whole article [WWW document] http://ieeexplore.ieee.org/xpls/abs_all.jsp?isnumber=17741&arnumber=818922&count=17&index=7.*

* cited by examiner

*Primary Examiner*—Chanh Nguyen
*Assistant Examiner*—Bao-Quan T Ho
(74) *Attorney, Agent, or Firm*—Jianq Chyun IP Office

(57) ABSTRACT

A source driver having the charge recycling function is suitable for a panel displaying device to drive a display array unit. The source driver includes a source driving circuit to output a plurality of data signals corresponding to a plurality of data lines. A circuit for recycling charges is coupled between the source driving circuit and the display array unit, including a plurality of switches to form a path of recycling charges and to transmit the data signals for driving the display array unit. A switch control circuit generates a set of control signals according to a timing relationship of the data signals of the circuit of source driving, to timely control the on/off states of each switch of the circuit for recycling charges. Consequently, a part of charges on the data lines can be recycled during a period of charging and discharging for the next period.

16 Claims, 13 Drawing Sheets

| | | | | | |
|---|---|---|---|---|---|
| + | − | + | − | + | − |
| − | + | − | + | − | + |
| + | − | + | − | + | − |
| − | + | − | + | − | + |
| + | − | + | − | + | − |
| − | + | − | + | − | + |

FIG. 4A(PRIOR ART)

| | | | | | |
|---|---|---|---|---|---|
| + | − | + | − | + | − |
| + | − | + | − | + | − |
| + | − | + | − | + | − |
| + | − | + | − | + | − |
| + | − | + | − | + | − |
| + | − | + | − | + | − |

FIG. 4B(PRIOR ART)

SOURCE DRIVER WITH CHARGE RECYCLING FUNCTION AND PANEL DISPLAYING DEVICE THEREOF

CROSS-REFERENCE TO RELATED APPLICATION

This application claims the priority benefit of Taiwan application serial no. 93137732, filed Dec. 7, 2004.

BACKGROUND OF THE INVENTION

1. Field of Invention

The present invention relates to a display technology of a panel display and, more particularly, to a source driver with charge recycling function.

2. Description of the Prior Art

In recent years, thanks to significant progress and development in display technology, the conventional Cathode-Ray Tube (CRT) displays have been replaced by the so-called panel displays. The most common panel display is TFT-LCD (thin-film transistor liquid crystal display). In addition, Light-Emitting-Diode Display (LED display) and Plasma Display Panel (PDP) are getting more market share day by day.

The display sector of a panel displaying device comprises pixel arrays which, in general, take an arrangement form of matrix with a plurality of line-column intersections, but each pixel is controlled by a driver which drives corresponding pixels based on the image data arranged in arrays.

FIG. 1 is a block diagram showing a source driver of a conventional LCD (Liquid Crystal Display), wherein the pixels are driven by the source driver and a gate driver in an LCD. To correct displayed colors, color calibration data will be input into the source driver. The source driver, as shown, comprises a shift register 100, a line latch 102, a level shifter 104, a DAC 106 (digital-to-analog converter), an output buffer 108, a signal receiver 110 and a data register 112. Wherein the DAC 106 would receive parallel input voltage levels VGMA1~VGMA14 of the Gamma-Color-Calibration Curve. The signal receiver 110 receives input signals, such as the signals related to RSDS (Reduced Swing Differential Signaling, a type of display interface format). In addition, output signals Y1, Y2, . . . from the output buffer 108 are to drive the pixels for the display purpose. The source driver shown in FIG. 1 is prior art, and should be apparent to those skilled in the art, so is not described in detail herein.

A basic configuration for a conventional LCD is shown in FIG. 2 which includes a TFT-LCD pixel array 120 for displaying an image. Wherein, in the pixel array 120, the line arrays and column arrays are driven by a plurality of source drivers 122 and a plurality of gate drivers 124, respectively; a power unit 130, such as a DC/DC converter, provides voltages to both the source driver 122 and the gate driver 124. In addition, an ASIC chip 126 (application specification integrated circuit chip) generates appropriate clock, control signals and color data etc. corresponding to the data signals required for the output from the source driver 122 and the gate driver 124 (shown as the output arrows in the figure). The required data signals are apparent to those skilled in the art, so are not described in detail herein.

FIG. 3 is a schematic diagram showing the driving mode. As illustrated in FIG. 3, a source driver 210 (122 in FIG. 2) includes an output buffer 212, which is connected to a ground voltage GND and an operation voltage VDD, and provides data lines, such as the data line 206*a*, 206*b*, 206*c* and 206*d*, with the data signal 208*a* and 208*b* for displaying the corresponding pixel 202 in the pixel array 200, wherein four pixels are taken as examples for a simple explanation. A scan line 204 is connected to a pixel line. Any single pixel 202 includes a TFT 202*a* and a capacitor 202*b* formed by a liquid crystal capacitor and a storage capacitor connected in parallel. In addition, according to driving mode of image pixels, the data lines are generally divided by data lines with odd number of channel and data lines with even number of channel. These two kinds of data signals provided by the output buffer 212 are AC voltage pulse signals. In terms of their maxim output voltages, these two data signals have waveforms shown as the signal 208*a* and the signal 208*b*, indicating a phase difference of 180 degree from each other.

In terms of driving mode, the output buffer 212 must continuously repeat charge/discharge processes between two voltage limits VDD and GND. According to the characteristic of the circuit, the output power of operation amplifier (OP) is:

$$OP = VDD \times N \times Cload \times Vswing \times (1/2) \times FH$$

Wherein, VDD is the voltage applying to the operation amplifier, N is the total number of data lines, Cload is the load capacitance of data lines, Vswing is the AC voltage swing provided by the operation amplifier for driving data lines, and the AC signals are chosen because the LCD pixels are driven in an AC mode. FH, i.e. horizontal frequency, is reciprocal of a period required for scanning a horizontal line within an image frame. Factor ½ is inducted here because in a period of an AC pulse wave signal, the effective swing voltage occupies only half of a whole period.

FIGS. 4A and 4B illustrate polarity arrangements of pixels in a frame in AC driving mode. In FIG. 4A the adjacent pixels are, for example, driven in different polarities, i.e. in dot inversion driving mode. On the other hand, in FIG. 4B, the pixels in two neighboring columns are, for example, driven in different polarities, i.e. in line inversion driving mode.

For the conventional configuration shown in FIG. 3, the AC voltage swing Vswing of data signals 208*a* and 208*b* is very large, therefore the output power of the operation amplifier provided by voltage VDD is also quite large. Also, along with the increasing application of portable display panels in recent years, reducing the panel power has become a bottle neck to be dealt with. Accordingly, how to make the display panel more electricity-saving to reduce the power for driving the panels is one of the important tasks for the manufacturers.

SUMMARY OF THE INVENTION

It is an object of the present invention to provide a source driver which has charge recycling function, enables the data lines to charge/discharge in advance, such that the source driver does not operate under the whole AC voltage swing Vswing in the charging/discharging operation corresponding to the data signals.

The other object of the present invention is to dispose the above source driver with charge recycling function in a panel display to make the panel display more electricity-saving.

The invention presents a source driver with the charge recycling function suitable for a panel displaying device to drive a display array unit. The source driver includes a source driving circuit to output a plurality of the data signals corresponding to a plurality of data lines. A circuit for recycling charges is coupled between the source driving circuit and the display array unit, wherein the circuit for recycling charges comprises a plurality of switches to form an electric path for recycling charges and to transmit the data signals for driving the display array unit. A switching control circuit generates a set of control signals according to a timing sequence of the data signals from the source driving circuit and timely controls the on/off state of each switch in the circuit for recycling charges. Thus, a portion of electric charges of the data lines are recycled in a charging and discharging period for use in the next period.

According to the other concept of the present invention, the above-mentioned circuit for recycling charges includes a plurality of capacitors for recycling charges coupled with the source driving circuit to recycle the portion of charges from the data lines.

According to the other concept of the present invention, the data lines are sorted in a set of data lines with odd numbers and another set of data lines with even numbers, arranged in alternative order and coupled to each other by switches. Accordingly, a loop circuit is formed through the control of the switching control circuit.

According to the other concept of the present invention, the above-mentioned odd number of data lines are coupled with a first capacitor for recycling charges by at least one of the switches, and the above-mentioned even number of data lines are coupled with a second capacitor for recycling charges by at least one of the switches.

According to the other concept of the present invention, the above-mentioned set of control signals, according to said timing sequence, controls the circuit for recycling charges to switch it off from the source driving circuit for a while as a time period for recycling charges. In the time period for recycling charges, first of all, the electric charges of the odd number of data lines are collected to the first capacitor for recycling charges and the electric charges of the even number of data lines are collected to the second capacitor for recycling charges. Next, the neighboring data lines of odd number and even number reach a common voltage. After that, the first capacitor for recycling charges and the second capacitor for recycling charges alternate to be coupled with the even number of data lines and the odd number of data lines respectively by said switches, and the voltages of the odd number of data lines and the even number of data lines are adjusted by the common voltages on the first and the second capacitors. Namely, the circuits for recycling charges first drive the odd number of data lines and the even number of data lines. Then, after the circuits for recycling charges are switched off from the odd number of data lines and the even number of data lines, the source driving circuit is connected with both the odd number of data lines and the even number of data lines such that the source driving circuit outputs a display data.

The present invention also provides a panel display, comprising a plurality of scan line drivers, a plurality of the above-mentioned source drivers and a display array unit coupled with both the scan line drivers the said source drivers to drive the display array unit for displaying an image.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve for explaining the principles of the invention.

FIGS. 4A and 4B illustrate a polarity arrangement of pixels of a frame in the AC driving mode.

DESCRIPTION OF THE EMBODIMENTS

Figure 1:
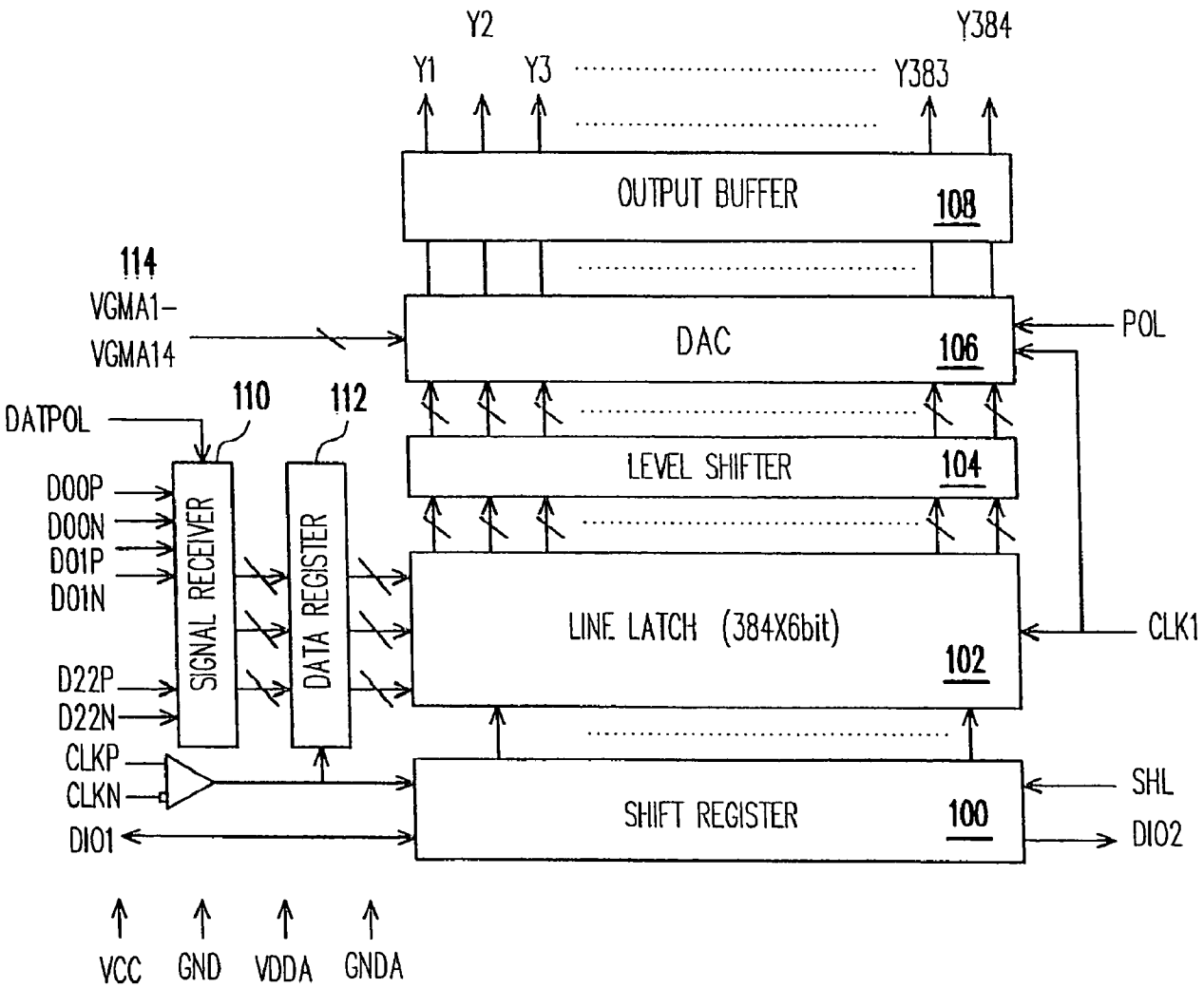
FIG. 1 (PRIOR ART)
FIG. 1 is a schematic drawing of a conventional source driver.
Figure 2:
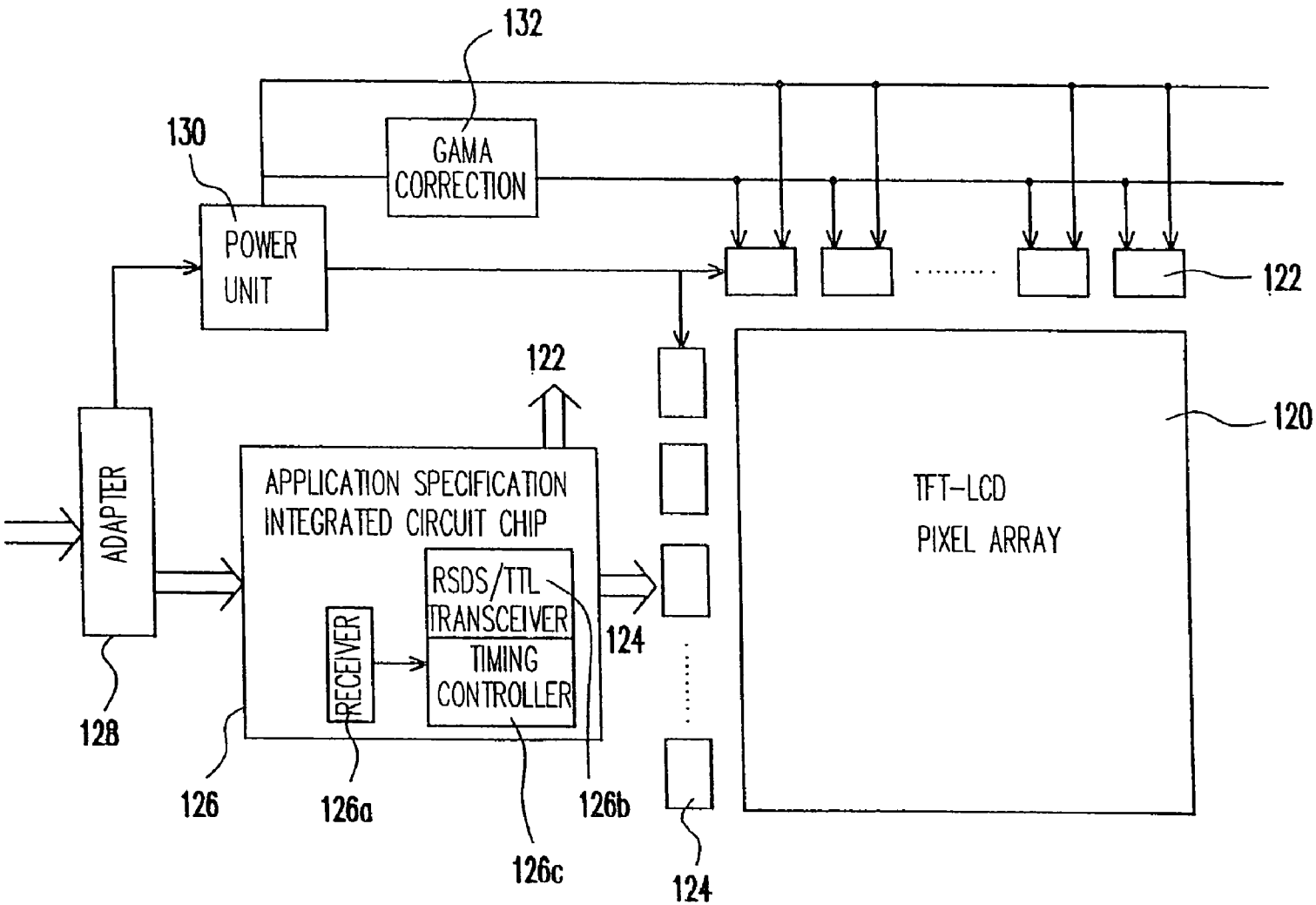
FIG. 2 (PRIOR ART)
FIG. 2 is a schematic drawing of a conventional LCD apparatus.
Figure 3:
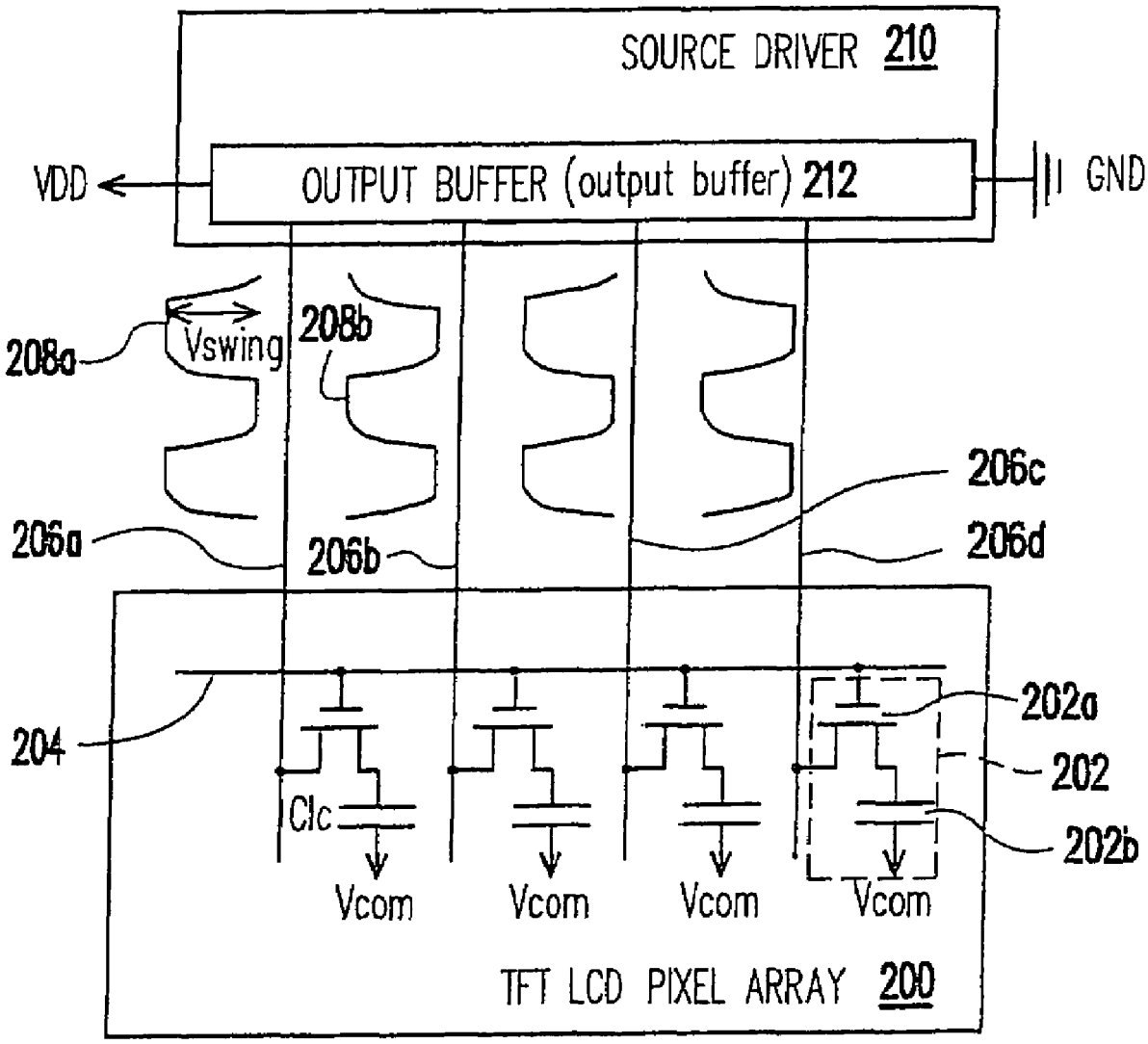
FIG. 3 (PRIOR ART)
FIG. 3 is a schematic drawing of a driving mode in a conventional LCD apparatus.

The present invention provides a source driver having the charge recycling function, and enabling the data lines to charge and discharge in advance. Compared with the conventional technique in FIG. 3, the operation amplifier of the output buffer 212 of the present invention does not output a whole AC voltage swing Vswing when charging and discharging the data lines of the pixel arrays corresponding to the data signals. The source driver in the present invention can collect the residual charges on the data lines and recycle them for pixels of a next row within a same image frame. Therefore, the operation amplifier does not operate under a whole AC voltage swing Vswing. Thus, at least, the goal for reducing power consumption can be reached.

Figure 5:
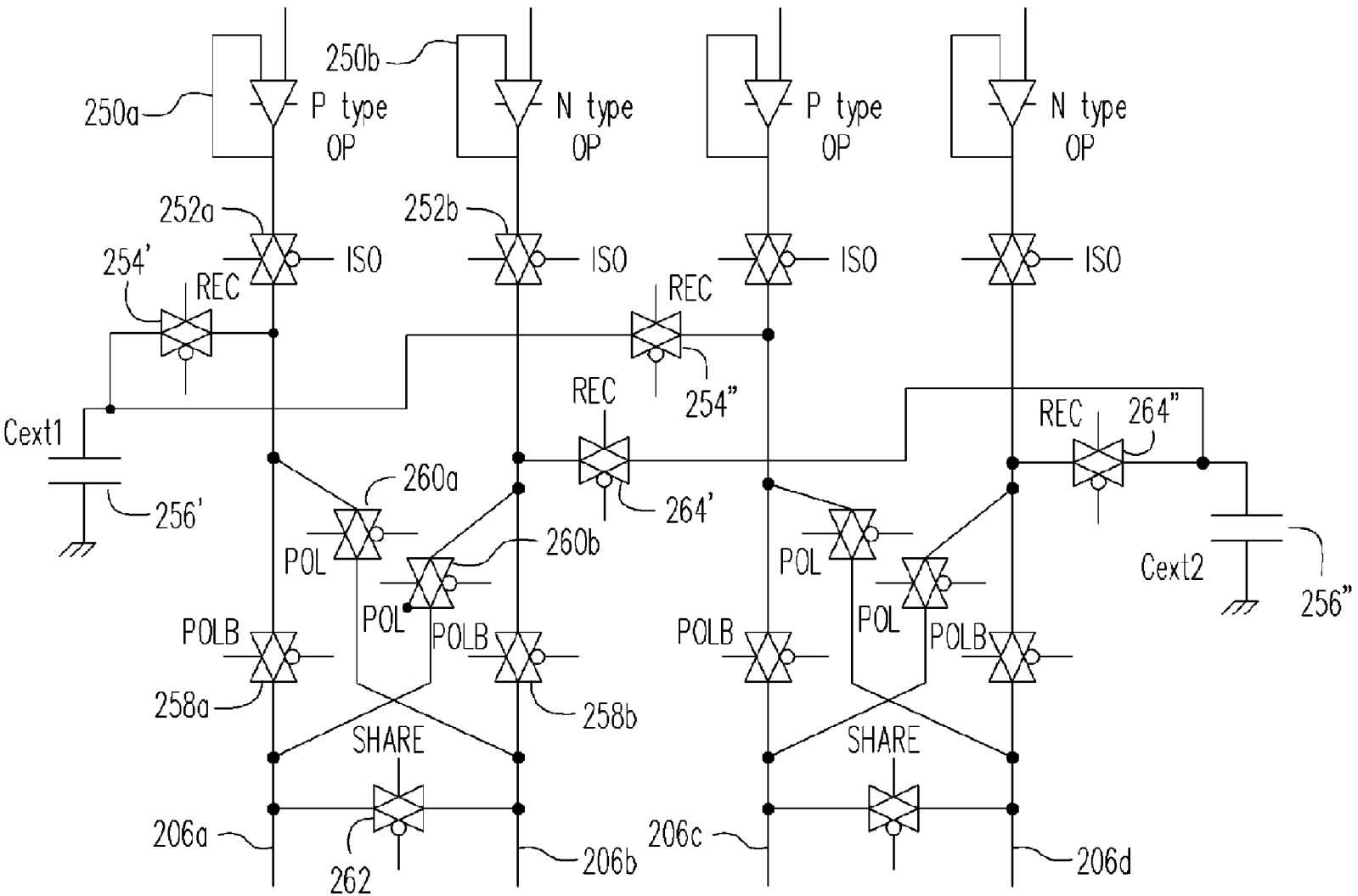
FIG. 5 is a schematic drawing of a structure of a circuit for recycling charges according to an embodiment of the present invention.

FIG. 5 is a schematic drawing of a structure of a circuit for recycling charges according to an embodiment of the present invention. In FIG. 5, only four data lines are shown as an example, but the present invention is not limited thereto. Referring to FIG. 5, the data lines can be divided by one set of data lines 206*a*, 206*c* with odd number, and another set of data lines 206*b*, 206*d* with even number. One end of each data line is connected with the pixel array 200 (referring FIG. 3), the other end of the data line can be connected with a conventional source driver, such as a source driving circuit. The source driving circuit includes the buffer 250*a*, 250*b* formed by an operation amplifier. More particularly, the buffer 250*a* and 250*b* are, for example but not limited to, formed by a P-type operation amplifier and an N-type operation amplifier. Furthermore, the buffer 250*a* formed by an operation amplifier is coupled with odd number of data line 206*a*, and the buffer 250*b* formed by an operation amplifier is coupled with even number of data line 206*b* to output data signals.

In addition, the circuit for recycling charges is disposed between the source driving circuit and the pixel array 200, and includes a plurality of switches 252*a*, 252*b*, 254', 254", 264', 264" . . . , to form the needed paths. The switch 252*a* and 252*b* are connected with the output end of the operation amplifier 250*a* and 250*b* respectively. A capacitor for recycling charges 256' is connected with both the odd number of data line 206*a* and 206*c* by means of the switch 254' and 254" respectively. Similarly, the capacitor for recycling charges 256" is connected with both the even number of data line 206*b* and 206*d* by means of the switch 264' and 264" respectively. On the odd number of data line 206*a*, there is also a switch 258*a* to connect to the pixel array 200 (referring to FIG. 3). On the adjacent data line 206*b*, an even number of data line, there is also a switch 258*b* to connect to the pixel array 200. And, the adjacent odd number of data line 206*a* and the even number of data line 206*b* have two switches 260*a* and 260*b* respectively connected in a crisscrossing manner, and a common switch 262 directly connected between the two adjacent data lines. In FIG. 5, only four data lines are given, 206*a*, 206*b*, 206*c* and 206*d*, as an example. In fact, the same principle can be applied to any plurality of data lines in odd and even numbers. Also, referring FIG. 5, a set of control signals, including ISO, REC, SHARE, POL, POLB, received by the aforementioned switches respectively control switch 252*a*+252*b*, 254'+254" and 264'+264", 262, 260*a*+260*b*, and 258*a*+258*b* respectively.

Besides, a switching control circuit (not shown) generates the above-mentioned control signals to timely control the on/off state of each switch in the circuit for recycling charges according to a timing relationship in the data signals of the source driving circuit, so that a portion of charges of the data lines can be recycled during the charging and discharging period for later use in the next period. The operation mechanism of the circuits is explained as follows.

Figure 6:
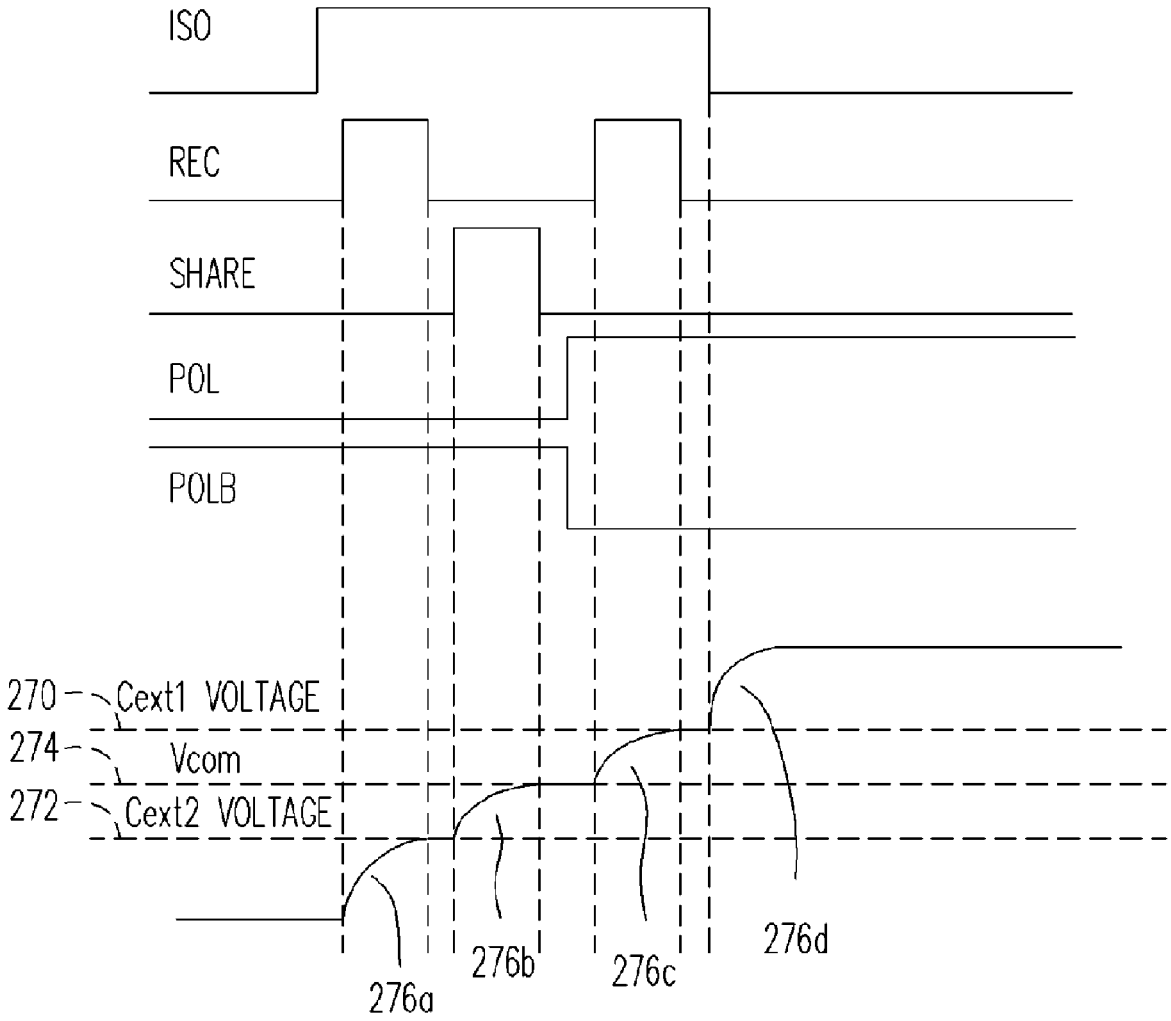
FIG. 6 is a timing chart corresponding to the control signals in FIG. 5.

FIG. 6 is a timing chart corresponding to the control signals in FIG. 5. Referring to FIG. 5 and FIG. 6, the high/low triggering levels of the control signals are determined according to the characteristics of the switches. The timing chart in FIG. 6 is used to explain the on/off states of the switch in relation to time. In the beginning, when the control signal ISO is at a low level and switches 252*a*, 252*b* are in an on state, so the data signal is input. At the moment, only control signal POLB stays at high level, switching on switches 258*a*, 258*b*. For example, for even number of data line 206*b*, a black data signal is input for pixel array 200.

Next, control signal ISO turns itself to a high level, disconnecting the data line and operation amplifier 250*a*, 250*b* for a certain time, the time for recycling charges. Along with high level state of ISO, switches 252*a* and 252*b* are switched off, thus output buffer 250*a* and 250*b* formed by operation amplifiers are isolated. When the control signal REC takes high level, the corresponding switches 254', 254", 264' and 264" are switched on. For even number of data line 206*b*, the residual charges on the data line with negative voltage will be collected in the capacitor for recycling charges 256", the status 276*a* in FIG. 6. All of the odd number of data lines 206*a* will certainly collect the residual charges thereon in the capacitor for recycling charges 256' (not shown in FIG. 6, but in FIG. 7). The voltage of the capacitor for recycling charges 256" is marked with 272.

Further, when the control signal REC turns back to a low level, and the control signal SHARE turns to a high level, the switch 262 is switched on. Then, a short circuit between adjacent odd data line 206*a* and even data line 206*b* would occur, and both lines reach a common voltage Vcom 274, the status 276*b*. Then, when SHARE turns to a low level, signal POL and POLB are reversed; that is, POL turns to a high level and, POLB is reduced to a low level. Meanwhile, REC turns to a high level again. At this point, the capacitor for recycling charges 256' changes its connection from the original odd data line 206*a* to the even data line 206*b*, and the capacitor for recycling charges 256" changes its connection from the original even data line 206*b* to the odd data line 206*a*. Meanwhile, the voltage of the even data line rises from the common voltage Vcom 274, to the voltage 270 of the capacitor for recycling charges 256', the status 276*c*. Furthermore, the control signal ISO returns to the low level to stop the status of recycling charges and to enter status 276*d*. At the moment, the even data line 206*b* has the same voltage as the capacitor for recycling charges 256'. And the next data of the even data line 206*b* is a positive voltage. Therefore, the changing can start from voltage 270, unlike the traditional mode where charging starts from a negative polarity with a negative voltage to a positive polarity with a positive voltage. To collect and recycle the charges, the control signal REC and SHARE are mainly used, with the effective width of pulse signal adjusted according to the actual situations. However, the preset timing sequence must be maintained; for example, signal REC must be triggered after the signal ISO. Also, the effective pulse of the signal SHARE occurs between two adjacent REC signals. Moreover, the electric polarity inversion of signals POL and POLB must take place between the timing of SHARE and REC.

Figure 7:
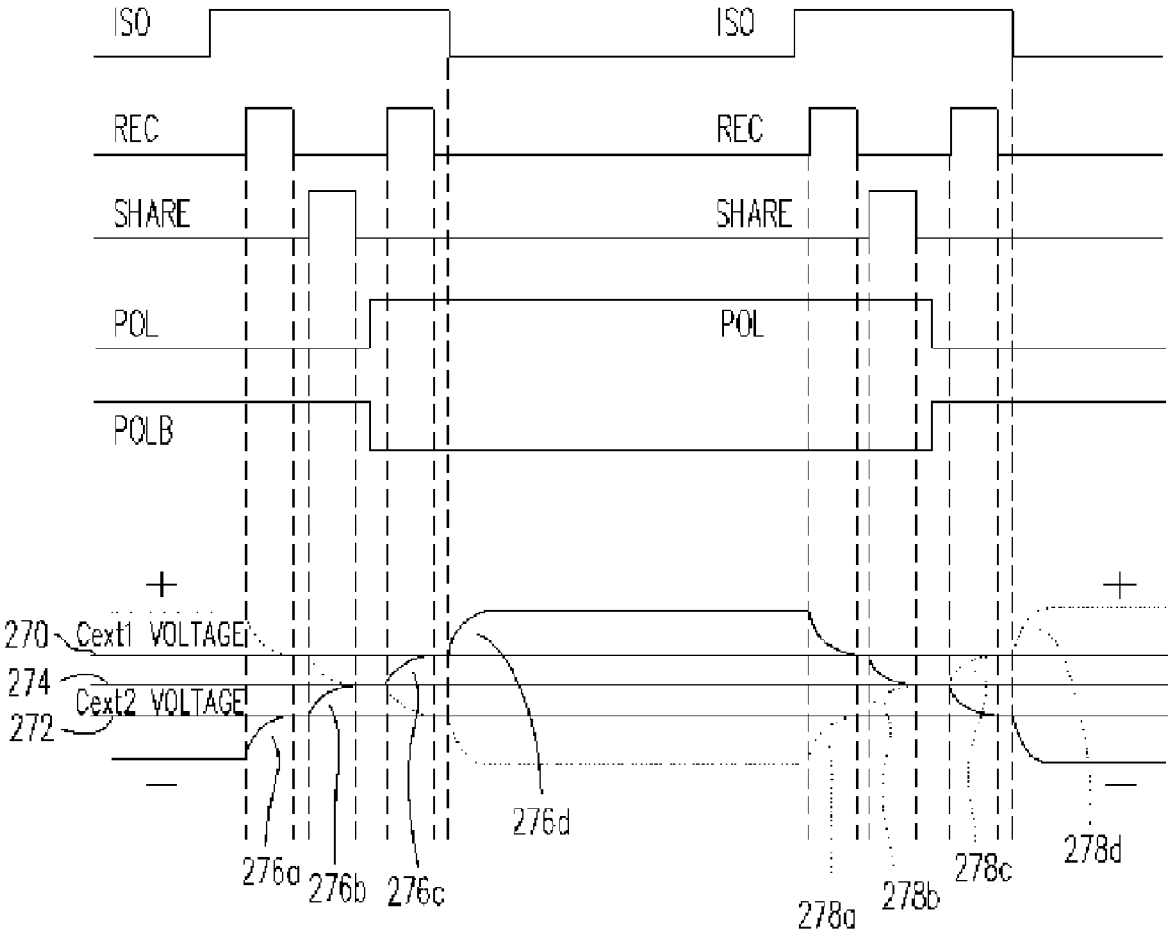
FIG. 7 is another timing chart corresponding to the control signals in FIG. 5.

FIG. 7 illustrates a timing chart of the control signals with two working cycles. As shown in FIGS. 4A and 4B, image pixels exchange the polarities of different place or dot and in different frame. In FIG. 7, the dot line represents the voltage curve of the odd data line 206*a*, for example, and the solid line represents the voltage curve of the even data line 206*b*. Between these two curves there is a two-way mapping relationship. For example, status 278*a*, 278*b*, 278*c* and 278*d* of the odd data line 206*a* in the second cycle represented in dot line have the same mechanism, where the negative polarity switches to positive polarity, as status 276*a*, 276*b*, 276*c* and 276*d* of the even data line 206*b*. And, each voltage status of the even data line 206*b* in the second cycle represented in dot line is inversely symmetric with status 276*a*, 276*b*, 276*c* and 276*d* respectively, where positive voltages switch to negative voltages.

Figure 8:
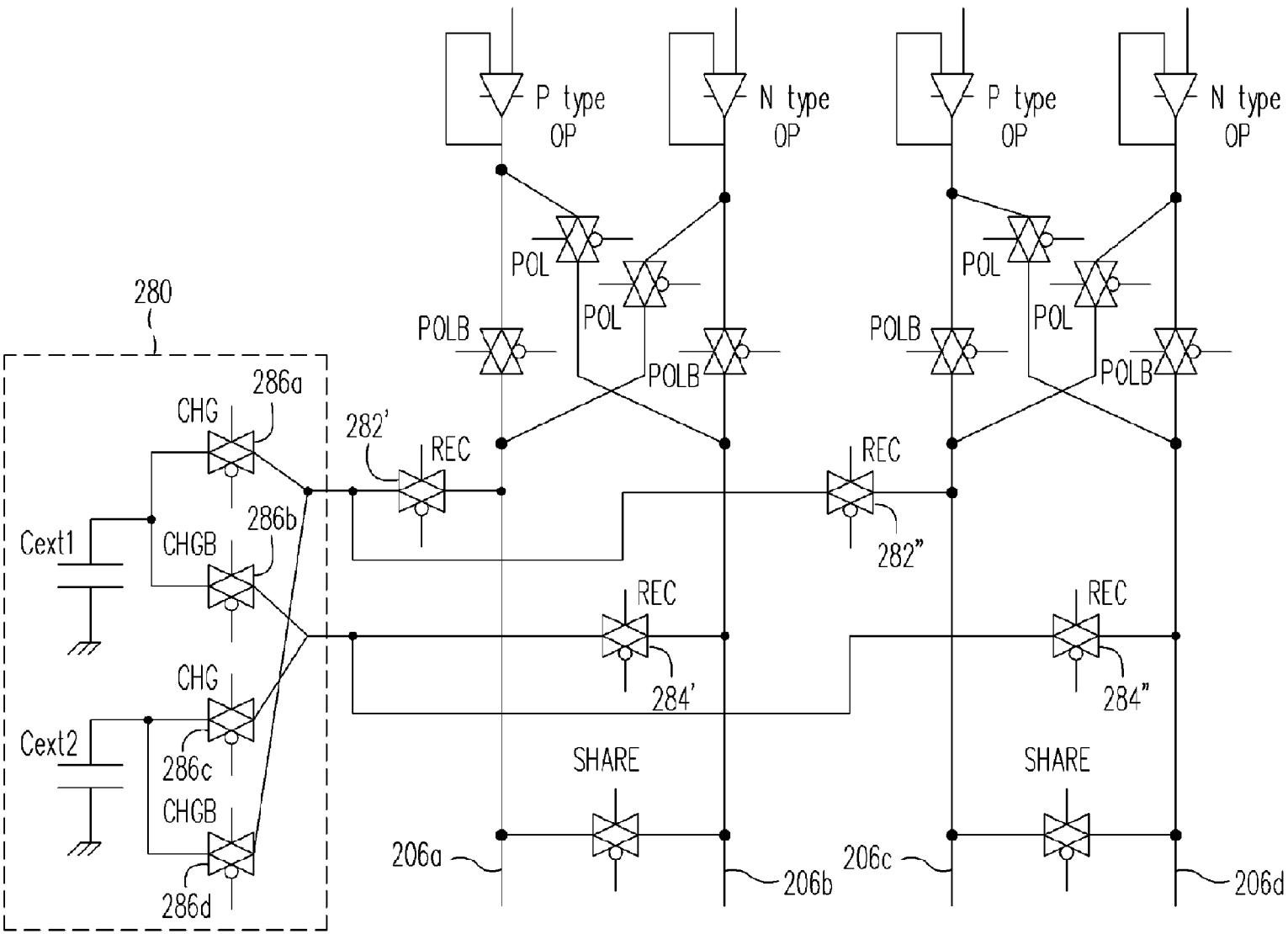
FIG. 8 is a schematic drawing of a structure of a circuit for recycling charges according to another embodiment of the present invention.

The design principle shown in FIG. 5 can be modified according to the actual requirement. FIG. 8 is a schematic drawing of another circuit according to the present invention. In FIG. 8, for each path of the data lines to have only one switch to reduce the output impedance of the operation amplifier, some switches can be removed from the original layout, in the form of a single circuit block 280. In the layout, capacitor Cext1, capacitor Cext2, and the switches 286*a*, 286*b*, 286*c* and 286*d* connected to the capacitors form the circuit block 280, but the switches for the control signal ISO are removed. On the other hand, one more set of control signals, CHG and CHGB, is required to control switches 286*a*, 286*b*, 286*c* and 286*d*.

Figure 9:
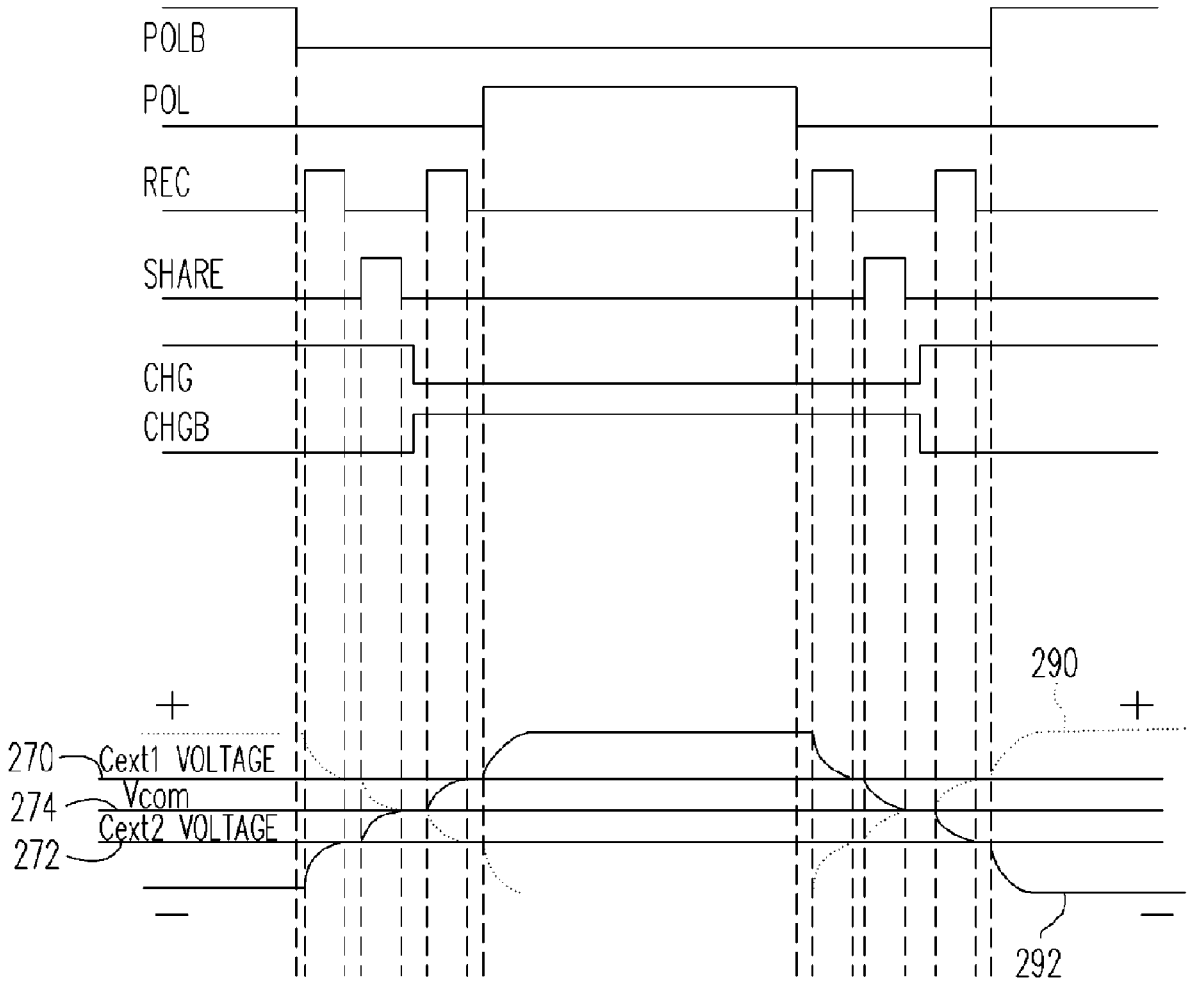
FIG. 9 is another timing chart corresponding to the control signals in FIG. 8.

To adapt a modified configuration of switches, the timing sequences of the control signals generated by a switching control circuit would change as shown in FIG. 9. Despite the changes, the operation mechanism remains the same for the purpose of recycling charges. In FIG. 9 POLB and POL signals are both at low level, the operation amplifiers are switched off from the pixel array for recycling charges. At this time, the switches 286*a*, 286*b*, 286*c* and 286*d*, accompanied by the control signal CHG and CHGB, perform the processes of charging and discharging electricity, as shown in FIG. 7. Comparatively, less load is carried by the operation amplifier for the modified layout.

The design principle can be modified to only recycle charges with the grey level far from white light. The normally white liquid crystal and the 6-bits RGB (red-green-black triplet colors) data are taken as an example. The data in level 63 in this instance represents the brightest level among the whole grey levels. The buffer formed by the operation amplifier outputs the lowest voltage, close to Vcom, with the lowest voltage swing Vswing. The data in level 0 represents the darkest level among the whole grey levels. The operation amplifier has the highest voltage, farthest away from Vcom, with the highest voltage swing Vswing. The normally black liquid crystals have the opposite conditions. The data in level 63 represents the brightest level among the whole grey levels. The operation amplifier has the highest voltage, farthest away from Vcom, with the highest voltage swing Vswing. The data in level 0 represents the darkest level among the whole grey levels. The operation amplifier has the lowest voltage, closest to Vcom, with the lowest voltage swing Vswing. For a further explanation, the normally black liquid crystal with level 32 as the dividing point among the whole grey levels is taken as an example in the following.

The most significant bit (MSB) among all data less than level 32 is set to zero; i.e., MSB=zero. The voltage swing Vswing is lower, so the approach of sharing charges is taken only to make two adjacent data lines a short circuit. However, for the data equal to or higher than level 32, i.e., MSB=1, its voltage swing Vswing is higher, for recycling charges. Accordingly, more recycled charges can be collected to serve the channels with higher voltage swing Vswing. Thus, as the buffer formed by the operation amplifier drives the loads of pixels in the subsequent phase, the output voltage swing Vswing can be reduced for saving the electricity.

Figure 10:
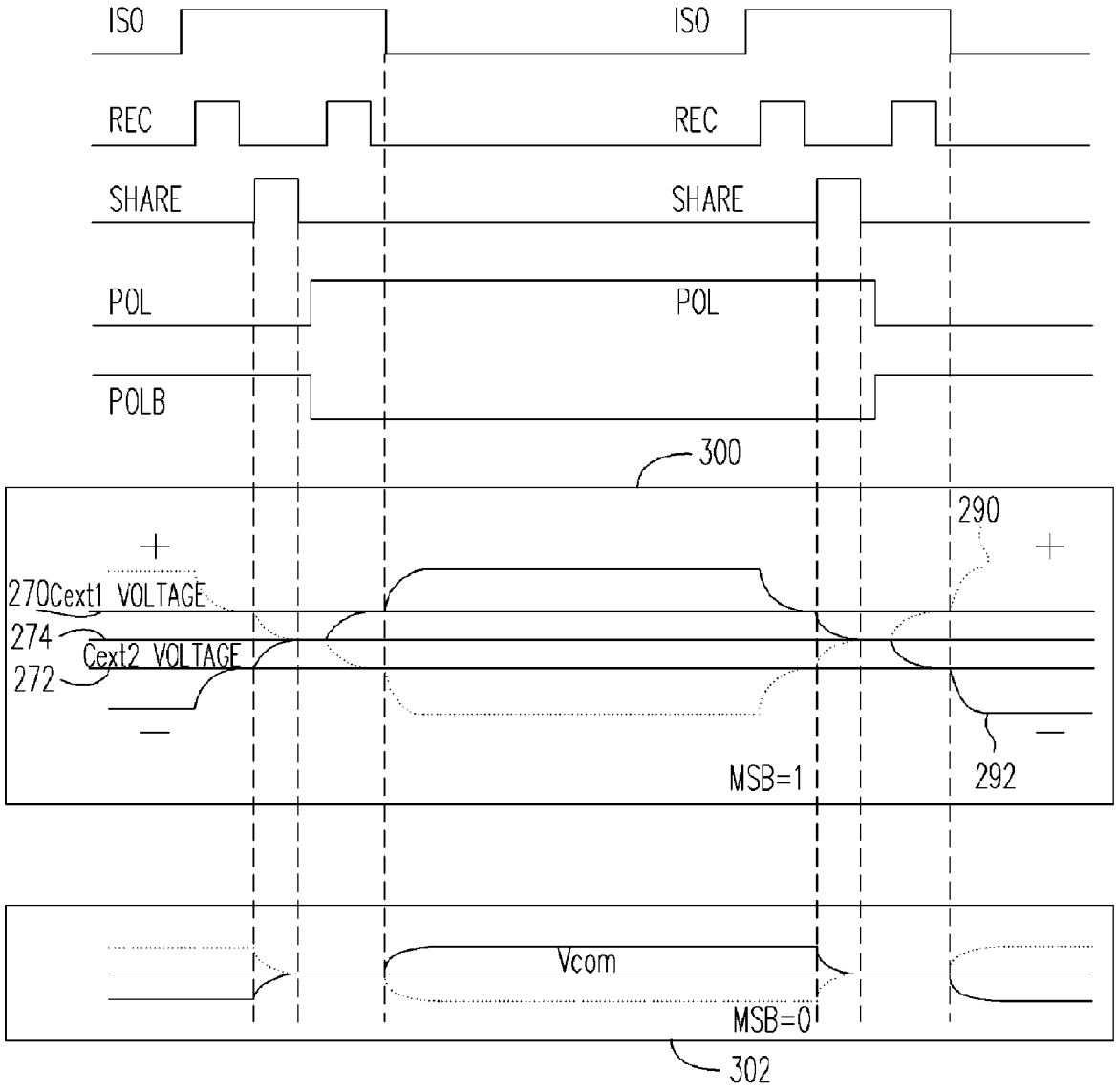
FIG. 10 is another timing chart corresponding to the control signals in FIG. 7 according to another embodiment of the present invention.

FIG. 10 shows a timing sequence corresponding to FIG. 7, with MSB taken into consideration. The voltage sub-chart marked as 300 represents the status of voltage when recycling the charges corresponding to the data lines of MSB=1. The voltage sub-chart marked as 302 represents the status of voltage when sharing the charges corresponding to the data lines of MSB=0.

Figure 11:
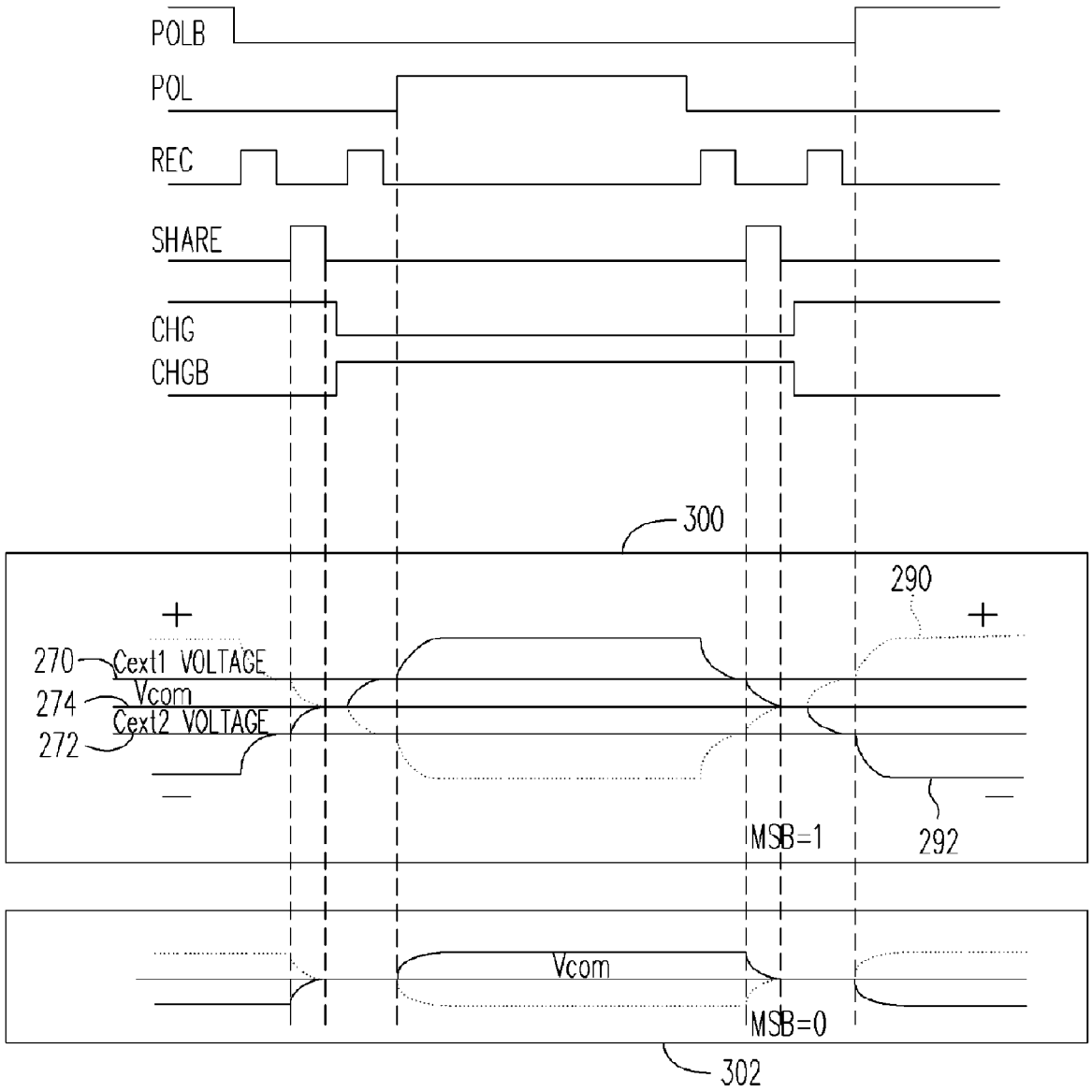
FIG. 11 is another timing chart corresponding to the control signals in FIG. 9 according to another embodiment of the present invention.

FIG. 11 shows a timing sequence corresponding to the control signals in FIG. 9, with MSB taken into consideration. The voltage sub-chart marked as 300 represents the status of voltage when recycling the charges corresponding to the data lines of MSB=1. The voltage sub-chart marked as 302 represents the status of voltage when sharing the charges corresponding to the data lines of MSB=0.

Figure 12:
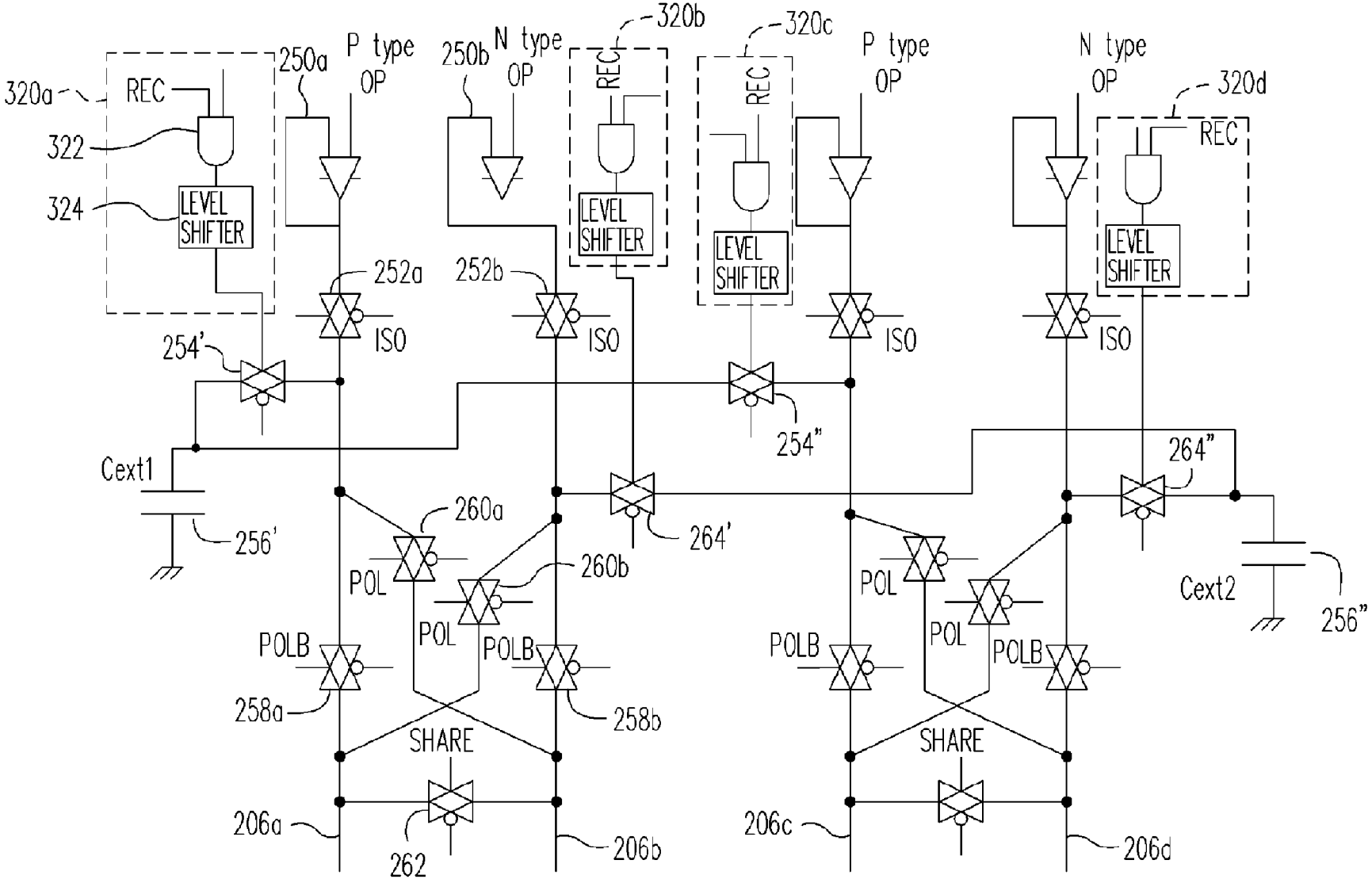
FIG. 12 is another embodiment of the present invention corresponding to the control signals in FIG. 10.

In terms of the circuit layout, the design of the circuit of recycling charges corresponding to FIG. 10 is similar to FIG. 5, as shown in FIG. 12.

In FIG. 5 the switches 254', 254", 264' and 264" are applied with REC control signals directly. By comparison, in FIG. 12 the switches 254', 254", 264' and 264" are applied with the results of logic-AND operations on REC signals and MSB of the data lines, as the design in, for example, the circuit block 320*a*, 320*b*, 320*c* and 320*d*. The rest of the circuit in FIG. 12 is the same as in FIG. 5.

Figure 13:
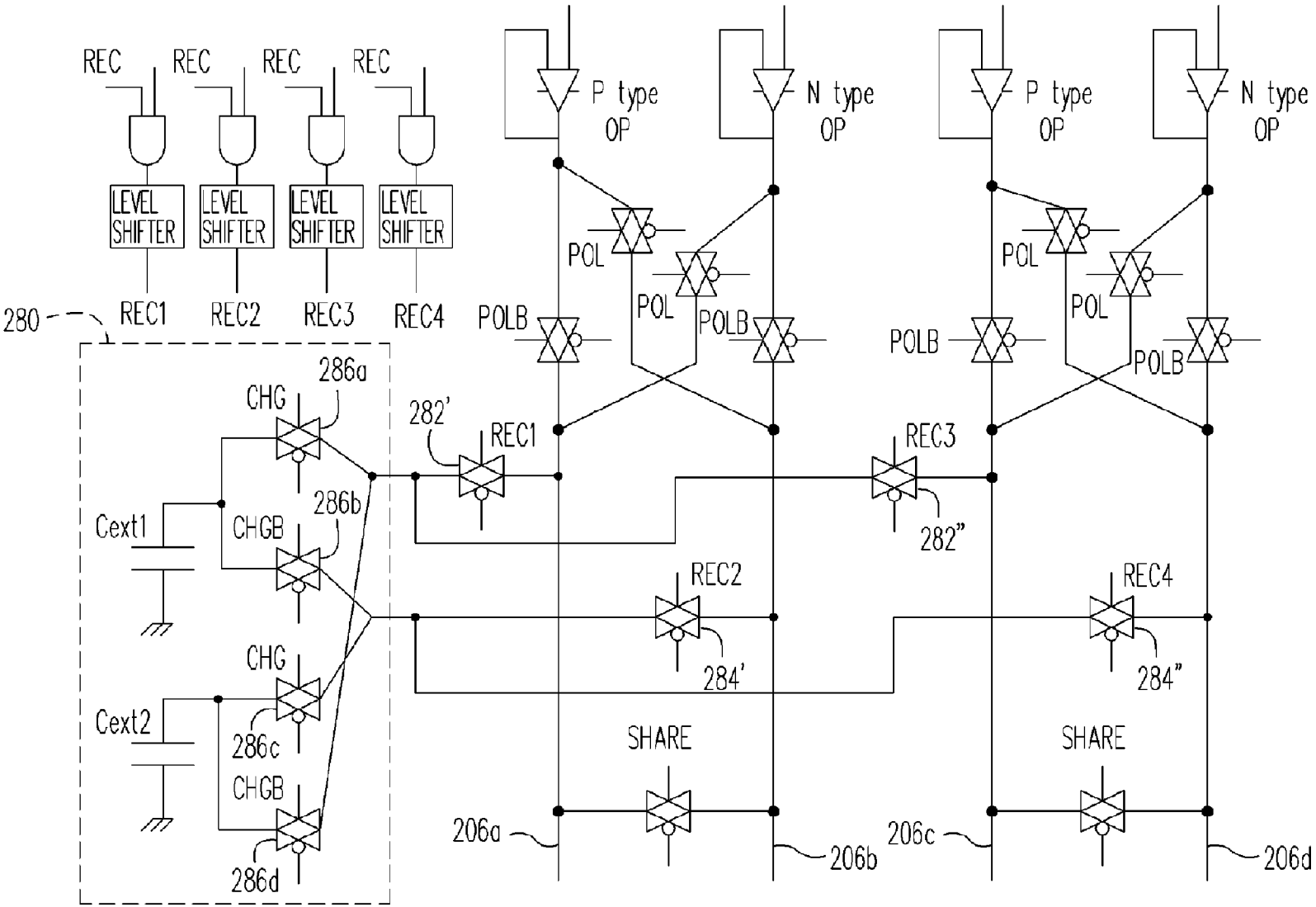
FIG. 13 is another embodiment of the present invention corresponding to the control signals in FIG. 11.

In FIG. 8, the switches 282', 282", 284' and 284" are applied with REC control signals directly. By comparison, in FIG. 13, the switches 282', 282", 284' and 284" are applied with the results of logic-AND operations on REC signals and MSB of the data lines, as the design in the circuit block in the top left side of the figure, where the control signals REC1, REC2, REC3 and REC4 are generated by the circuit blocks to apply on switches 282', 282", 284' and 284." The rest of the circuit in FIG. 13 is the same as in FIG. 8.

To sum up, a source driver is provided by the present invention, featuring the charge recycling function. The data lines are charged and discharged in advance, such that the source driver does not operate under a whole voltage swing Vswing during the charging/discharging operation corresponding to the data lines .

Further, the circuit for recycling charges in the source driver of the present invention is compatible with the conventional source drivers, so the purpose of saving electricity can be achieved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A source driver with the charge recycling function suitable for a panel displaying device to drive a display array unit, the source driver comprising:

a source driving circuit, coupled to a plurality of data lines, outputting a plurality of data signals;

a plurality of polarization switch circuits, coupled to the source driving circuit, the i-th plurality of polarization switch circuit is used to switch the (2*i−1)-th and (2*i)-th data signals to the (2*i−1)-th and (2*i)-th data lines respectively, or to the (2*i)-th and (2*i−1)-th data lines respectively according to a polarization signal and an inversed polarization signal, wherein i is a natural number;

a circuit for recycling charges, coupled between the display array unit and the polarization switch circuit, comprising a plurality of switches, a first and second capacitors, so as to form a charge recycling path and to transmit the data signals for driving the display array unit, wherein the switches are controlled by a recycling control signal, a charge control signal and a inversed charge control signal;

wherein, when the recycling control signal, the charge control signal and the inversed charge control signal control the switches to make the first capacitor coupled to the (2*i−1)-th data line through the switches, the second capacitor is coupled to the (2*i)-th data line through the switches; and when the recycling control signal, the charge control signal and the inversed charge control signal control the switches to make the first capacitor coupled to the (2*i)-th data line through the switches, the second capacitor is coupled to the (2*i−1)-th data line through the switches.

2. The source driver as recited in claim 1, further comprising:

a plurality equalization switches, coupled between the (2*i−1)-th and (2*i)-th data lines, controlled by a share control signal.

3. The source driver as recited in claim 2, further comprising:

a switch control circuit, generating the share control signal, the polarization control signal, the inversed polarization control signal, the charge control signal, the inversed charge control signal, the recycling control signal.

4. The source driver as recited in claim 1, wherein the first and second capacitors are used to recycle charges on the (2*i−1)-th and (2*i)-th data lines respectively when the first and second capacitors are respectively coupled to the (2*i−1)-th and (2*i)-th data lines through the switches; and the first and second capacitors are used to recycle the charges on the (2*i)-th and (2*i−1)-th data lines respectively when the first and second capacitors are respectively coupled to the (2*i)-th and (2*i−1)-th data lines through the switches.

5. The source driver as recited in claim 1, wherein, wherein each path between the source driving circuit and the display array unit has only one polarization switch.

6. The source driver as recited in claim 1, wherein the circuit for recycling charges only recycles residual charges on a part of the data lines with a grey level beyond a preset value.

7. The source driver as recited in claim 1, wherein a most significant bit (MSB) of the data corresponding to the data lines is chosen to form the part of the data lines.

8. The source driver as recited in claim 1, wherein during a period of recycling charges, the charges of the (2*i−1)-th data line are collected into the first capacitor at first and then the charges of the (2*i)-th data line are collected into the second capacitor;

both the (2*i−1)-th data line and (2*i)-th data line reach a common voltage;

the first capacitor and the second capacitor alternate to be coupled respectively with the (2*i)-th data line and the (2*i−1)-th data line to adjust said voltages of the (2*i−1)-th data line and the (2*i)-th data line from the common voltage level; and the circuit for recycling charges is switched off from the (2*i−1)th data line and the (2*i)-th data line, and the source driving circuit is conducted with the (2*i−1)-th data line and the (2*i)-th data line to make the circuit for recycling charges output a displaying data for driving said display unit.

9. A panel displaying device, comprising:

a plurality of scan line drivers;

a plurality of source drivers, each of the source drivers comprises:

a source driving circuit, coupled to a plurality of data lines, outputting a plurality of data signals;

a plurality of polarization switch circuits, coupled to the source driving circuit, the i-th plurality of polarization switch circuit is used to switch the (2*i−1)-th and (2*i)-th data signals to the (2*i−1)-th and (2*i)-th data lines respectively, or to the (2*i)-th and (2*i−1)-th data lines respectively according to a polarization signal and an inversed polarization signal, wherein i is a natural number;

a circuit for recycling charges, coupled between the display array unit and the polarization switch circuit, comprising a plurality of switches, a first and second capacitors, so as to form a charge recycling path and to transmit the data signals for driving the display array unit, wherein the switches are controlled by a recycling control signal, a charge control signal and a inversed charge control signal;

wherein, when the recycling control signal, the charge control signal and the inversed charge control signal control the switches to make the first capacitor coupled to the (2*i−1)-th data line through the switches, the second capacitor is coupled to the (2*i)-th data line through the switches; and when the recycling control signal, the charge control signal and the inversed charge control signal control the switches to make the first capacitor coupled to the (2*i)-th data line through the switches, the second capacitor is coupled to the (2*i−1)-th data line through the switches; and a display array unit coupled with the scan line drivers and the source drivers to drive the display array unit for displaying an image.

10. The panel displaying device as recited in claim 9, wherein each of the source drivers further comprises:

a plurality equalization switches, coupled between the (2*i−1)-th and (2*i)-th data lines, controlled by a share control signal.

11. The panel displaying device as recited in claim 9, wherein each of the source drivers further comprises:

a switch control circuit, generating the share control signal, the polarization control signal, the inversed polarization control signal, the charge control signal, the inversed charge control signal, the recycling control signal.

12. The panel displaying device as recited in claim 9, wherein the first and second capacitors are used to recycle charges on the (2*i−1)-th and (2*i)-th data lines respectively when the first and second capacitors are respectively coupled to the (2*i−1)-th and (2*i)-th data lines through the switches; and the first and second capacitors are used to recycle the charges on the (2*i)-th and (2*i−1)-th data lines respectively when the first and second capacitors are respectively coupled to the (2*i)-th and (2*i−1)-th data lines through the switches.

13. The panel displaying device as recited in claim 9, wherein, wherein each path between the source driving circuit and the display array unit has only one polarization switch.

14. The panel displaying device as recited in claim 9, wherein the circuit for recycling charges only recycles residual charges on a part of the data lines with a grey level beyond a preset value.

15. The panel displaying device as recited in claim 9, wherein a most significant bit (MSB) of the data corresponding to the data lines is chosen to form the part of the data lines.

16. The panel displaying device as recited in claim 9, wherein during a period of recycling charges, the charges of the (2*i−1)-th data line are collected into the first capacitor at first and then the charges of the (2*i)-th data Line are collected into the second capacitor;

both the (2*i−1)-th data line and (2*i)-th data line reach a common voltage;

the first capacitor and the second capacitor alternate to be coupled respectively with the (2*i)-th data line and the (2*i−1)-th data line to adjust said voltages of the (2*i−1)-th data line and the (2*i)-th data line from the common voltage level; and the circuit for recycling charges is switched off from the (2*i1)-th data line and the (2*i)-th data line, and the source driving circuit is conducted with the (2*i−1)-th data line and the (2*i)-th data line to make the circuit for recycling charges output a displaying data for driving said display unit.

* * * * *